United States Patent [19]

Finley

[11] 4,104,950

[45] Aug. 8, 1978

[54] DEMULTIPLEX AND STORAGE SYSTEM FOR TIME DIVISION MULTIPLEXED FRAMES OF MUSICAL DATA

[75] Inventor: William Solon Finley, Lewisburg, Tenn.

[73] Assignee: Teledyne, Inc., Los Angeles, Calif.

[21] Appl. No.: 681,098

[22] Filed: Apr. 28, 1976

[51] Int. Cl.[2] ..... G10G 3/04

[52] U.S. Cl. ..... 84/462; 84/1.01; 84/1.28; 84/DIG. 29; 84/115

[58] Field of Search ..... 84/1.01, 1.03, 1.16, 84/1.24, DIG. 29, 115, 461–463, 464

[56] References Cited

U.S. PATENT DOCUMENTS

| | | | |
|---|---|---|---|
| 3,604,299 | 9/1971 | Englund | 84/1.03 |
| 3,647,929 | 3/1972 | Milde, Jr. | 84/1.01 |
| 3,771,406 | 11/1973 | Wheelwright | 84/464 |
| 3,789,719 | 2/1974 | Mailiet | 84/115 |
| 3,865,002 | 2/1975 | Shimuzu et al. | 84/115 |
| 3,868,882 | 3/1975 | Fukui et al. | 84/462 |
| 3,871,247 | 3/1975 | Bonham | 84/1.16 |
| 3,895,554 | 7/1975 | Mailiet | 84/115 |
| 3,905,267 | 9/1975 | Vincent | 84/115 |

*Primary Examiner*—Robert K. Schaefer
*Assistant Examiner*—Vit W. Miska
*Attorney, Agent, or Firm*—Jim Zegeer

[57] ABSTRACT

There is disclosed a system for demultiplexing and storing time division multiplexed frames of musical data encoded ina bi-phase mark/space code. Data in sequential groups of data bit cells is stored in a shift register while a counter counts the data bit cells. A plurality of latch circuits, each capable of storing one said group of data, are sequentially enabled to receive and store the data, in the groups, respectively. After all of the data bit cells in a given time frame are stored, they are simultaneously gated to transistor driver circuits for operating solenoids which, in turn, re-create the music.

3 Claims, 4 Drawing Figures

BIT ASSIGNMENT

| | | | | | |
|---|---|---|---|---|---|
| 1. | $C\#_{16}$ | 44. | G# | 87. | $B_{32}$ |
| 2. | D | 45. | A | 88. | $C_{16}$ |
| 3. | D# | 46. | A# | 89. | |
| 4. | E | 47. | B | 90. | |
| 5. | F | 48. | C | 91. | |
| 6. | F# | 49. | C# | 92. | 0 |
| 7. | G | 50. | D | 93. | |
| 8. | G# | 51. | D# | 94. | |
| 9. | A | 52. | E | 95. | |
| 10. | A# | 53. | F | 96. | |
| 11. | B | 54.. | F# | 97. | |
| 12. | C | 55. | G | 98. | 0 |
| 13. | C# | 56. | G# | 99. | |
| 14. | D | 57. | A | 100. | |
| 15. | D# | 58. | A# | 101. | |
| 16. | E | 59. | B | 102. | |
| 17. | F | 60. | C | 103. | |
| 18. | F# | 61. | C# | 104. | 0 |
| 19. | G | 62. | D | 105. | BASS THEME |
| 20. | G# | 63. | D# | 106. | BASS INTENSITY 1 |
| 21. | A | 64. | E | 107. | BASS INTENSITY 2 |
| 22. | A# | 65. | F | 108. | BASS INTENSITY 3 |
| 23. | B | 66. | F# | 109. | BASS INTENSITY 4 |
| 24. | C | 67. | G | 110. | 0 |
| 25. | C# | 68. | G# | 111. | TREBLE THEME |
| 26. | D | 69. | A | 112. | TREBLE INTENSITY 1 |
| 27. | D# | 70. | A# | 113. | TREBLE INTENSITY 2 |
| 28. | E | 71. | B | 114. | TREBLE INTENSITY 3 |
| 29. | F | 72. | C | 115. | TREBLE INTENSITY 4 |
| 30. | F# | 73. | C# | 116. | 0 |
| 31. | G | 74. | D | 117. | SUSTAIN PEDAL |
| 32. | G# | 75. | D# | 118. | SOFT PEDAL |
| 33. | A | 76. | E | 119. | |
| 34. | A# | 77. | F | 120. | |
| 35. | B | 78. | F# | 121. | 1 |
| 36. | C (MIDDLE) | 79. | G | 122. | 1 |
| 37. | C# | 80. | G# | 123. | 1 |
| 38. | D | 81. | A | 124. | 1 |
| 39. | D# | 82. | A# | 125. | 1 SYNC |
| 40. | E | 83. | B | 126. | 1 |
| 41. | F | 84. | C | 127. | 0 |
| 42. | F# | 85. | $A_{32}$ | 128. | 1 |
| 43. | G | 86. | $A\#_{32}$ | | |

(14 UNASSIGNED BITS)

FIG. 2

DEMULTIPLEX AND STORAGE SYSTEM FOR TIME DIVISION MULTIPLEXED FRAMES OF MUSICAL DATA

BACKGROUND OF THE INVENTION

This invention relates to electronic musical instruments using time division multiplexed signal trains for carrying musical data to re-create a performance that has been recorded. A number of systems are known in the art and reference is made to Englund U.S. Pat. No. 3,604,299 and Maillet U.S. Pat. No. 3,789,719 as recent examples. Maillet uses a triac and operates his solenoid from the 115 VAC line. The triac cuts off on the half cycle unless it is gated on. The only way for the circuit to work consistently would be for a very high sampling rate. Even then there would be considerable 60 cycle hum. Englund utilizes a pulse stretching technique which is an analog control and hence may limit how rapidly the instrument may be played. That is, it requires time to cut solenoids off.

THE PRESENT INVENTION

The present invention avoids these problems. The invention centers on an 8 bit addressable latch and a bit counter. The first three counts of the bit counter are the bit address counts and go to the address inputs of the addressable latch circuits. The last four counts of the bit counter are decoded using four to sixteen decoder. One of the 16 decoded outputs goes to one of 16 latches which in turn enables each 8 bit addressable latch one at a time and in the same sequence as the multiplex function. As the bit address count addresses a bit, the enable input enables latch: if the data is high, a high is latched into that output, and if the data is low, a low is latched into the output.

BRIEF DESCRIPTION OF THE DRAWINGS

The above and other objects, advantages, and features of the invention will become more apparent in light of the following specification and accompanying drawings wherein:

FIG. 2 is a chart illustrating the bit assignments in a player system incorporating the invention, and FIG. 3A and FIG. 3B, taken together, constitute a schematic diagram of the playback circuit illustrating a preferred form of expression system incorporating the invention.

DETAILED DESCRIPTION

Attached hereto and incorporated herein as an integral part of the disclosure of this specification, is the "Service Manual" for "Teledyne Piano Recorder/-Player Model PP-1 Assembly Number 3288" ATL 3263, a publication of the assignee hereof and sometimes referred to hereinafter as "Service Manual".

Attached hereto and incorporated herein as an integral part of this specification is the "Assembly Instruction for Teledyne Piano Recorder/Player Model PP-1 Assembly Number ATL-3288 Document Number ATL 3262"; a publication of the assignee hereof and sometimes referred to hereinafter as "Installation Manual".

The above publications describe in detail a specific and preferred embodiment of an electronic player piano incorporating the invention defined in the claims hereof as made and sold by the assignee hereof.

Figure 1:
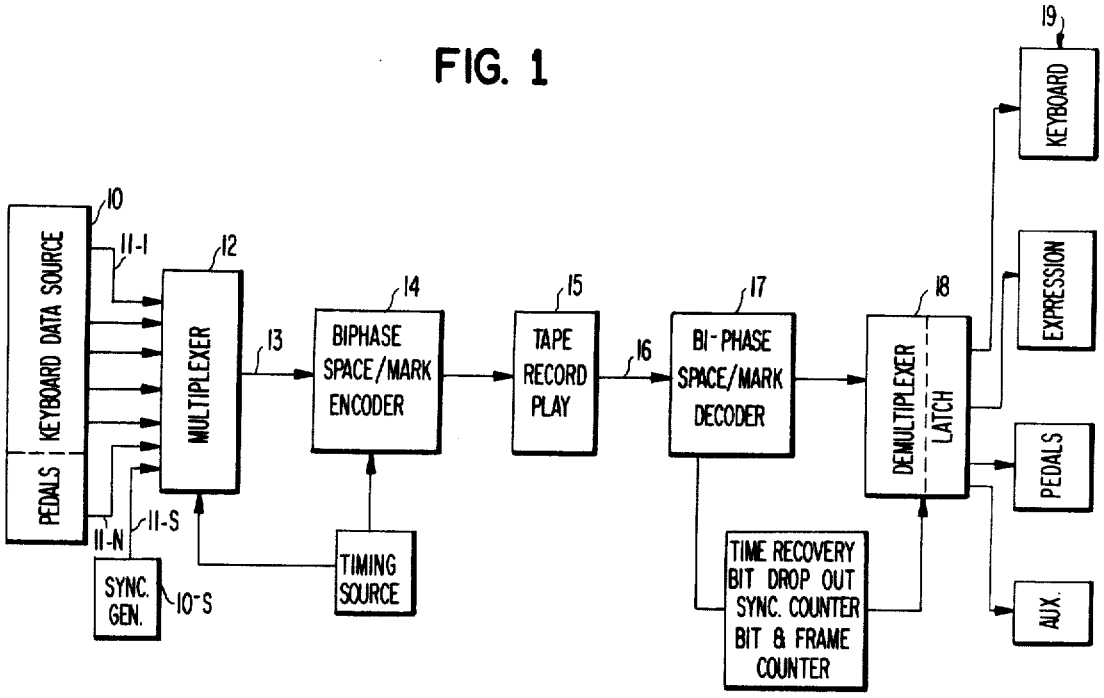
FIG. 1 is a block diagram of an electronic recorder and player system for musical instruments.

Referring now to FIG. 1, the keyboard of a piano is designated by the numeral 10 as a keyboard data source. It could be any musical keyboard instrument source such as a harpsicord, carillon, organ, piano, etc., and each output or switch actuation is indicated by a single line 11-1 through 11-N, the number of such output lines corresponding to the number of key switch actuations to be sensed and recorded for example, eighty keys, the "sustain" and "soft" pedals of an eithy-eight key piano may be sensed. A multiplexer 12 (shown in detail in said Service Manual) scans or looks at each individual line 11-1 . . 11-N in a timed sequence which constitutes frames. Thus, the key switches, sustain and loud pedal, actuations are sensed by the digital multiplexer 12, one at a time, and in a generally sequential fashion. However, if no transpositions are contemplated, it is not necessary that they be sequentially examined; they may be looked at or scanned in groups and in any fashion or order, the only criteria being that the position of the particular switch in its scan time be maintained in the entire system. As shown in the Bit Assignment Chart (FIG. 2), bit positions 121–128 are sync bits and are constituted by 11111101 and these are generated by sync generator 10-S which provides a set of eight bits which are sequenced by multiplexor 12 in the same way as key switch actuations. The block labelled "timing source" is a conventional clock pulse generator which generates time frames for the multiplexor 12 for converting the parallel data input to a serial data.

The multiplexer thereby translates the parallel data of the key switch actuations to a serial data stream along its output line 13. This data is then encoded to a bi-phase space (or mark) signal in bi-phase space (or mark) encoder 14 and then recorded on magnetic tape in tape recorder 15. It will be appreciated that magnetic tape recorder 15 is conventional in all material respects and need not be disclosed or described in any detail herein. It can be the same as is disclosed in any of the prior art patents referred to earlier herein for recording digital data on tape or, preferably, any good quality cassette tape recorder having proper input signal shaping networks, output signal correcting networks and amplifiers to produce the digital output signals.

As mentioned earlier, there is a slight difference in the time when a key of a piano, for example, is struck and when the note reaches the maximum sound intensity so that if a microphone is used to detect intensity, a delay (not shown) may be introduced prior to the encoding of the keyboard binary bits at positions 1–88 of bit assignment chart of FIG. 2 (all 88 keys of a piano have assigned bit positions, but, not all to be recorded). On the other hand, acceleration sensing devices or other forms of transducers may be used to measure the acceleration or force with which the key is struck by the artist and this data converted to binary form as the expression data for recording on tape without such delay.

The tapes may be recorded beforehand by known or accomplished artists or in home recordings, or, as presently contemplated, rerecordings of punched paper rolls, etc. which have expression signal information so that one need not equip a piano for the record function disclosed herein. Thus, the particular manner by which the expression data is detected and recorded forms no part of the present invention.

On playback by the tape recorder 15, the bi-phase space (or mark) data appears at the output of a read head and is fed through correcting networks and amplifiers to recover the digital signal. The data from the read head is approximately a sine wave, but the output from the amplifier on line 16 is a square wave signal. Moreover, the signal from the read head has included therein the clock data which is recovered and used in the demultiplexing operation.

The bi-phase space (or mark) decoder circuit 17 decodes the incoming data on line 16 and applies same to demultiplexer 18 which distributes the data to the appropriate control channels in the storage and solenoid actuator circuits 19.

THE DECODER (FIG. 3)

Signals on line 1 from the tape are applied via optical coupler U1. Such optical couplers are conventional and include an optically coupled diode-transistor pair and their isolating, base bias and collector load resistors $R_5$, $R_6$ and $R_7$ respectively. The output signal being amplified by transistor 40 (Q1) whose collector is connected via resistor $R_8$ to the supply voltage.

Figure 3A:
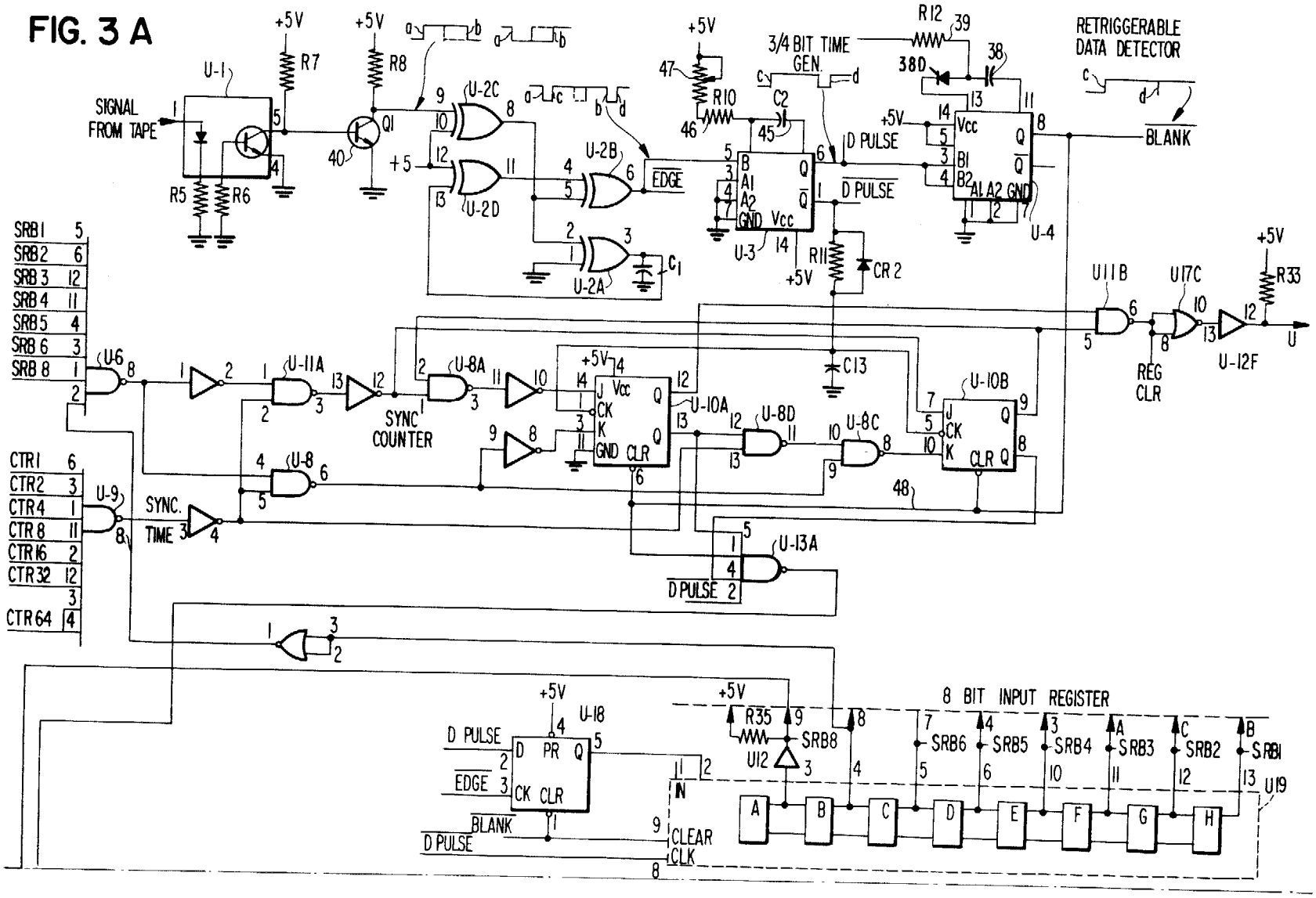

The decoder is shown in FIG. 3 and includes the EDGE detection circuit utilizing U-2, the "D Pulse" monostable U-3, and the decoder using U-18. U-2 is a SN7484, U-3 a SN74121, and U-18 a SN7474. All are made by a number of manufacturers, Texas Instruments being one. The four exclusive OR gates of U-2, (U-2A, U-2B, U-2C and U-2D) and the delay generated by capacitor Cl generate a narrow spike called EDGE as shown in FIG. 3.

DATA DROPOUT DETECTOR

If a dropout of data occurs in the tape recording, there can be a loss of sync which causes wrong notes to be struck during the frame of data in which the dropout occurs and this can be quite disconcerting to a listener. The same disconcerting playing of notes can occur if the tape recorder is stopped while notes are being played. The circuit portion of FIG. 3 which is most significant for this aspect of the circuit is block U-4 which is the retriggerable data detector, and is a Texas Instruments' integrated circuit type SN74122. It is a retriggerable monostable multivibrator described at pages 138–140 of Texas Instruments 1973 TTL Data Book. The output of retriggerable monostable multivibrator circuit U-4 stays high as indicated in the waveform diagram from the Q output terminal 8 for a time determined by the values of feedback capacitor 38 and resistor 39. A diode 38D is used to discharge the capacitor 38. In the beginning, pulses are applied from the tape recorder output circuit, which are amplified and applied as an input to optical couple U-1. This optical coupling circuit U-1 is conventional, having as an output thereof a square wave which is applied as an input to transistor amplifier 40.

The output of transistor amplifier 40 is the bi-phase space encoded data. The edges trigger the non-retriggerable monostable multivibrator U-3 and the length of time the Q output of this multivibrator is high is determined by capacitor 45 and resistors 46 and 47, resistor 46 being adjusted so that the D pulse output is three quarters the bit time of the information. With the bi-phase space/mark code described above, when the first zero of the data occurs, the monostable begins to trigger on the edge that exists at the end of the bit cell. As noted earlier, there is a transition at the beginning of every bit period which is the same as the end of the bit cell for the succeeding period. The edge that occurs, due to a one on the middle of the bit cell is ignored due to the timing and delay which comes about from the adjustments of the capacitors and resistors described above. The edge is then utilized to clock the CLK or clock input to D flip flop U-18, and the D pulse is applied to the D input of edge detector U-18. The negative edge of the D pulse is used to store the output of U-18 into the input register of the eight bit input register U-19. The NRZ data is recovered at the Q output of U-18 and may be supplied to a shift register (not shown) for transposition purposes, if desired.

Referring now to the retriggerable monostable multivibrator U-4, as long as the positive going edges occur in less than the predetermined time, the monostable is reset and begins timing out again. If, due to a slow tape speed, data dropout or recorder stopping, or no information being recorded on the tape, e.g., a blank tape, no edge occurs in the D pulse input of retriggerable data detector U-4 and the device times out and clears the sync counter constituted by integrated circuits U-10A and U-10B and the input register both of which prevent notes from being struck or held in a closed state. The timing is adjusted to just longer than the expected time between the positive going edge of the D pulse. If the edge does not occur during the expected time, the output drops and clears the system.

THE SYNC COUNTER

If there is a loss of synchronization, wrong notes can be struck by the musical instrument which can be quite disconcerting. The prior systems sensed these sync codes and automatically reset. In accordance with the present invention to insure that at power on, and at the start of a tape recorder or after a data dropout on the tape, no wrong notes are struck, a sync counter has been utilized to count three sync codes before allowing any note to be struck (these would be the three sync sequences in the bit assignment chart of FIG. 2 at bit positions 121–128). This counter is reset by the output of data detector circuit U-4 line 48 (labeled "Blank") that detects if there is data dropout on the tape or the tape recorder is running at the wrong speed or that the power has just been turned on. This sync counter, constituted basically by integrated JK flip flop circuits U-10A and U-10B, also allows for the possibility that the sync code could possibly occur randomly in the data information and rejects the false sync.

The retriggerable data detector circuit U-4 has a blank output which clears the counter to a zero count if there is not any data being received, at power on, if the tape dropout occurs or if tape speed variations exist. If the Q output of U-10A or U-10B is zero, U-11B NAND gate is high, a register clear pulse clears all output registers to thereby prevent any keys (notes) from being played. Therefore, until both JK flip flops U-10A and U-10B outputs are high (one) there cannot be any notes played or struck. NAND gate U-13A output "load" holds the bit counters U-14 and U-15 to all ones count, which, in turn, is detected by NAND gate U-9. When the incoming data from U-18 is shifted through the eight bit input register U-19, and contains the sync code, the NAND gate U-6 detects same and sync detect output becomes low. When the outputs of NAND gates U-6 and U-9 are low as well as the Q output of JK flip flop U-10B and the data detector (Q or U-4) is high, the next pulse (the D pulse at Q of U-3) is coupled through resistor R-11 and diode CR-2 and delayed by capacitor 13 and clocks U-10A and U-10B as well as clocking the bit counter which has been released by U-13A load 27 output.

At this time, the J and K outputs of flip flop U-10A are zero and the J and K outputs of U-10B are one and the CLK changes U-10B Q to a one and inverted Q to a zero. The bit counter U-14, U-15 continues to count until it counts 128 counts and returns to all ones again. If the data is correct and the retriggerable data detector U-4 blank output stays high, the sync code is again in the eight bit register U-19. U-6 and U-9 detect the sync time again. Their outputs are inverted and applied to NAND gates U-11A and U-8B which via Nand gates U-8A allows U-10A J input to go to a one and the U-10A K input to zero, while U-10B J and K go to one. When the U-10A and U-10B are clock, they both change states so as U-10A Q is one and U-10B is zero. The register clear (Reg. Clr.) signal stays high and the keys are still not allowed to play. After 128 more counts, U-10B J is high and upon clocking, U-10B Q becomes a one and the register clear becomes a zero, thus allowing the notes to be struck. In essence, then, the system requires two complete frames of 128 bits before any notes may be struck after any disturbance causing the data detector or sync detect NAND gate to indicate a malfunction. The counting of two frames of sync pulses is illustrated in the context of Vincent U.S. Pat. No. 3,905,267. Inverters, such as U-12, U-12A–U-12F are conventional integrated circuit digital pulse inverters (e.g., a digital "one" becomes a digital "zero" and vice versa) are used where the logic of the system requires it and a detailed description is not necessary. Likewise, isolating or blocking, etc. diodes such as CR-3–CR-20 are used in conventional manner and are not inventive with the applicant herein.

DEMULTIPLEX AND LATCH

The bit counters U-14 and U-15 along with the 8 bit input register U-19 demultiplex the serial data stream from the Q output terminal of U-18. Each succeeding group of eight bits is sequentially shifted into shift register U-19, and then transferred to latch circuits L-1, L-2 . . . L-N corresponding to the number of modules (10 in this case) containing key switches S-1–S-80. Bit counter outputs CTR-8, CTR-16, CTR-32 and CTR-64 are supplied to four line to sixteen line converter U-5 so that upon the output lines thereof appear, in sequence, enabling pulses for each of the latch circuits L. The D pulse from pin 6 of U-3 is coupled via NAND gate U-11C (connected as an inverter) and series resistor R15 and shunt capacitor C-4 and similarly connected NAND gate U-11D to the 4 line to 16 line converter U-5. Bit counter outputs CTR-1, CTR-2, CTR-3 are the unit select inputs to expression and pedal latch circuits EPL-1 and EPL-2 (U-20 and U-21).

Figure 3B:
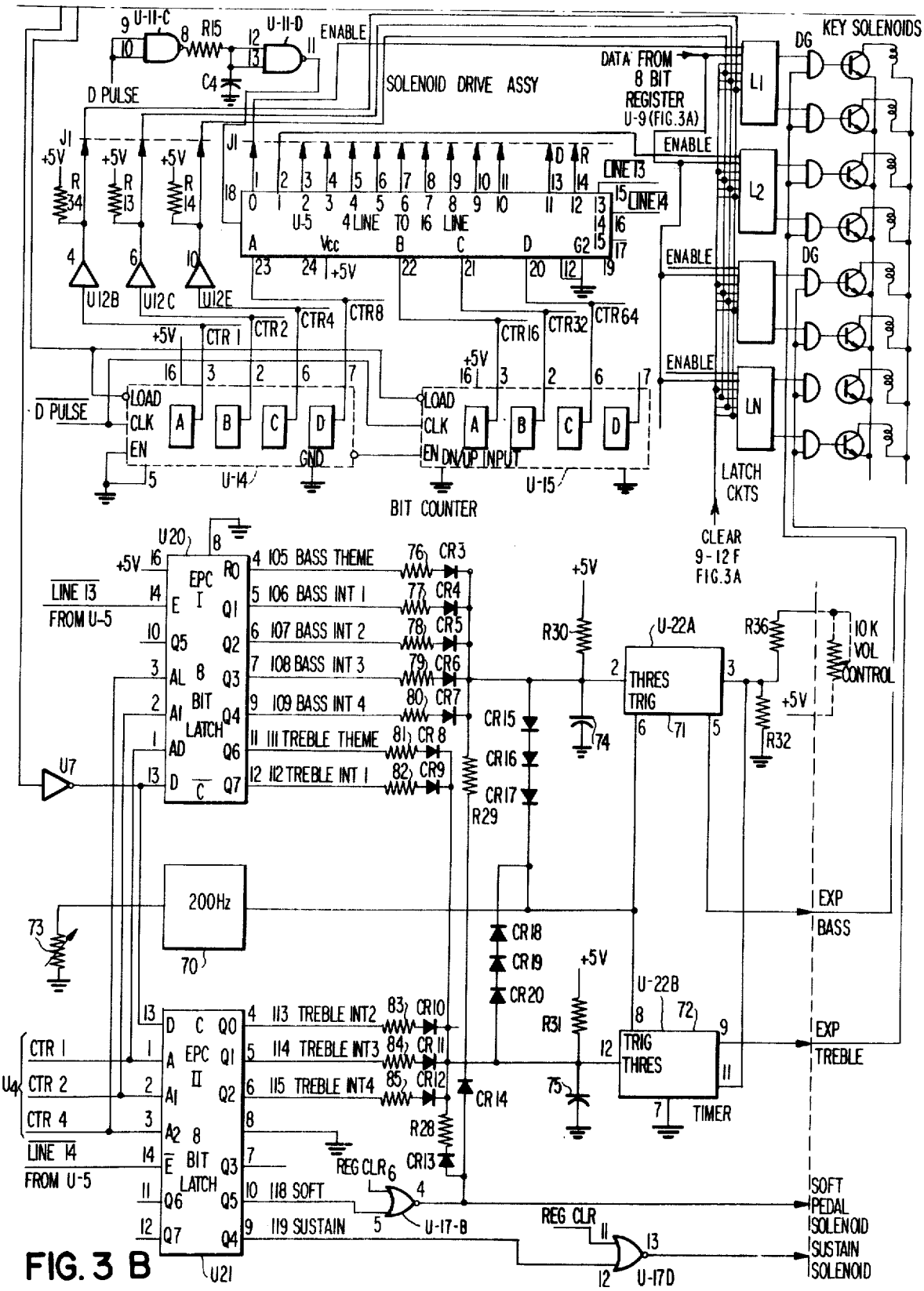

As shown in FIG. 3B each latch circuit L1, L2 . . . LN receives the data bits on their respective data input terminals D (terminal 13) from the 8-bit input register U19 (FIG. 3A) which delays the data one bit time. The data is supplied serially in the storage units of the latch circuits L1, L2 . . . LN. As the data is sent, counters U14–U15 (FIG. 3B) and the 4-line to 16-line converter U5 set the storage place in the latch circuits for each bit. Thus, the counter 1, counter 2, and counter 4 output bits (CTR1, CTR2, and CTR4) determine which place a bit is to be stored in a group of eight so that as each latch circuit is enabled, the data bits issuing from the 8-bit input register, delayed one bit at a time, are stored in the latch circuits with the outputs of the 4-line to 16-line converter (U5 of FIG. 3B). A total of 16 groups times 8 per group which makes 128 channels with the first group being selected by the one output terminal of U5 and as indicated in FIG. 3B (see paragraph 3.5.6 "Data Transfer" of the Teledyne Service Manual).

Thus, each of the latch circuits L stores the musical information contained in a data cell of the 128 bit time frame. Driver transistor AND gates DG, one for each key on the keyboard receive as one input a signal from the latch or storage circuits L. The second input to the driver transistor AND gate DG is a sequence of pulses which are width modulated according to the information stored in expression and pedal control latch circuits EPL.

EXPRESSION

A low frequency (200 Hz) oscillator 70 (U-16) supplies pulses to a pair of pulse width modulatable one shot monostable multivibrators 71 and 72 (U-22A and U-22B) for the bass and treble keys, respectively. The pulses from oscillator 70 have their minimum width set by a variable resistor 73 which thus sets the minimum width of the pulses from multivibrators 71 and 72. Each multivibrator 71 and 72 has its timing set by capacitors 74 and 75, respectively, in conjunction with resistors 76–80 for the bass volume and resistors 81–85 for the treble volume. Combinations of resistors 76–80 and combinations of resistors 81–85 are selected by the information enabled by counter bits CTR-1–CTR-3 which have been stored in expression and pedal control latch circuits U-20 and U-21, which are enabled by two successive outputs ($\overline{\text{line 13}}$ and $\overline{\text{line 14}}$) from the four line to sixteen line converter U-5. This stores the treble and bass expression bits in latch circuits EPL-1 and EPL-2 along with the soft and sustain pedal controls. It will be noted that the latter are also prevented from being actuated on data drop, loss of sync, etc. by a "Register Clear" signal at U-17B and U-17D. The stored bits are used to vary the number of resistors R76–R80 and R81–R85 (which are essentially binary weighted) in circuit with timing capacitors 74 and 75, respectively, to thereby vary the charging rate of the capacitors according to the combination of resistors which have been, in effect, connected in circuit with a capacitor (74 or 75), to thereby vary the width of the pulses established by U-22A for bass effects and U-22B for treble effects.

The bass effect pulse width pulses are supplied to the group of driver transistor AND gates DG-B for the bass notes solenoid control as the second input thereto and the treble effect pulse width modulated pulses are supplied to the driver transistor AND gates DG-T for the treble note solenoid control transistors.

If the sync pulse sequence is detected and there has been no loss of sync, data dropout, etc. as described above, the musical notes stored in the latch circuits are played.

It will now be seen how the invention accomplishes its various objects and the various advantages of the invention will likewise be apparent. While the invention has been described and illustrated herein by reference to certain preferred embodiments, it is to be understood that various changes and modifications may be made in the invention by those skilled in the art, without departing from the inventive concept, the scope of which is to be determined by the appended claims.

What is claimed is:

1. Apparatus for re-creating a musical presentation on a controlled musical instrument wherein the musical presentation is digitally recorded on magnetic tape in serial order time frames of time division multiplexed data bit cells encoded in a bi-phase mark/space code comprising:

(a) means for decoding said bi-phase mark/space code;

(b) counter means for counting the decoded data bit cells;

(c) a storage shift register for storing the information in a selected sequential group of data cells within a time frame;

(d) a plurality of multiple latch circuits means, the number of latches in each multiple latch circuit equalling the number of data cells in said sequential groups;

(e) means operated by said counter means for producing and applying an enabling pulse to each of said plurality of multiple latch circuits in a selected sequence;

(f) means connecting said storage register to said multiple latch circuits for simultaneously transferring the musical data stored in said storage register to said multiple latch circuits during said enabling pulse; and (g) means operated at the end of each time frame for operating the controls of said musical instrument according to the condition of said multiple latch circuits.

2. The invention defined in claim 1 wherein said musical instrument includes a plurality of electrical solenoids, one for each note to be played on said instrument, and transistor means for controllably driving each said solenoid, at least some of said musical data cells in a time frame having contained therein expression data bits corresponding to intensity, a further latch circuit means for storing said expression data bits, said means for counting said data cells also producing enabling pulses unique to said further latch circuit means, means for deriving a sequence of pulses for controlling said transistor means; and means for modulating the width of said sequence of pulses for controlling said transistor means as a function of the data bits stored in said further latch circuit means.

3. Apparatus for re-creating a musical presentation on a musical instrument which is digitally recorded on magnetic tape in serial order frames of time division multiplexed data bit cells, selected ones of said data bit cells having stored therein musical information corresponding to notes of the musical instrument to be played in re-creating said musical presentation, means for reading said magnetic tape, first storage means for sequentially storing the musical data from a selected group of said data cells in a given time frame, a plurality of groups of latch circuit means, one latch circuit for each of the notes of said instrument to be played, for receiving and storing the musical data from the selected groups the data stored in said first storage means, counter means for sequentially counting said data cells and producing an enabling pulse unique to each group of said latch circuit means, and there being one such enabling pulse produced for each group of latch circuits, means for applying said enabling pulses, in the sequence of their production following storage of musical data in said first storage means to thereby transfer the musical data in a selected group data cells, to the latch circuits enabled by said enabling pulses, and means for sensing the end of a frame of data and causing the simultaneous transfer of musical data from said latch circuits to said musical instrument to cause the playing of the musical information stored in said data cells.

* * * * *